US006926804B2

(12) United States Patent
Gardner et al.

(10) Patent No.: US 6,926,804 B2
(45) Date of Patent: Aug. 9, 2005

(54) MULTI-TIER ROPE HARNESS

(75) Inventors: Curtis L. Gardner, Colonie, NY (US); Alan L. Billings, Clifton Park, NY (US)

(73) Assignee: Albany International Corp., Albany, NY (US)

( * ) Notice: Subject to any disclaimer, the term of this patent is extended or adjusted under 35 U.S.C. 154(b) by 323 days.

(21) Appl. No.: 10/298,733

(22) Filed: Nov. 18, 2002

(65) Prior Publication Data

US 2004/0094280 A1 May 20, 2004

(51) Int. Cl.[7] ..... D21F 5/00

(52) U.S. Cl. ..... 162/273; 162/199; 162/200; 162/358.1; 162/900; 426/131; 426/192; 426/105; 34/120; 428/99

(58) Field of Search ..... 162/199, 200, 162/273, 358.1, 900, 902; 426/131, 192, 193, 105, 107, 280; 34/120; 428/99

(56) References Cited

U.S. PATENT DOCUMENTS 5,306,393 A 4/1994 Rhyne
5,429,719 A 7/1995 Rhyne
6,398,915 B1 6/2002 Fargeout
6,447,873 B1 9/2002 Kornett

FOREIGN PATENT DOCUMENTS

DE 201 06 128 U 5/2002

*Primary Examiner*—Peter Chin
*Assistant Examiner*—Mark Halpern
(74) *Attorney, Agent, or Firm*—Frommer Lawrence & Haug LLP; Ronald R. Santucci

(57) ABSTRACT

A multi-tier fabric loading harness for installing a fabric onto a papermaking machine. The loading harness has a first portion with a supporting rigid member that attaches to an end of the fabric in the cross-machine direction and a plurality of apertures spaced across its width. The first tier is formed by a rope sequentially laced through the apertures to form self-aligning loops. A second rope is sequentially laced through the loops of the first tier to form self-aligning loops for a second tier. A pull ring gathers the loops of the second tier and is used to pull the fabric onto the papermaking machine.

11 Claims, 5 Drawing Sheets

MULTI-TIER ROPE HARNESS

BACKGROUND OF THE INVENTION

1. Field of the Invention

The present invention relates to the papermaking arts. More specifically, the present invention relates to a leader harness used to pull a seamable papermaker's fabric onto a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

As implied above, forming fabrics function to form and convey the paper product being manufactured to the press section. However, forming fabrics also need to address water removal and sheet formation issues. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper. Press fabrics accept the large quantities of water extracted from the wet paper in the press nip. Hence, void volume is also important in press fabrics to provide a path for the water to go. The fabric must also have adequate permeability to water for its entire useful life. Finally, press fabrics must be able to prevent the water accepted from the wet paper from returning to and rewetting the paper upon exit from the press nip.

Woven fabrics take many different forms. For example, they may be woven endless, or flat woven and subsequently rendered into endless form with a seam. Woven fabrics are typically in the form of endless loops, or are seamable into such forms, having a specific length, measured longitudinally therearound, and a specific width, measured transversely thereacross. Because paper machine configurations vary widely, paper machine clothing manufacturers are required to produce fabrics, and other paper machine clothing, to the dimensions required to fit particular positions in the paper machines of their customers. Needless to say, this requirement makes it difficult to streamline the manufacturing process, as each fabric must typically be made to order.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, about half of those used in press sections of the paper machines today are on-machine-seamable. Some Paper Industry Process Belts (PIPBs) are contemplated to have an on machine seam capability, such as some transfer belts, known as Transbelt®. Installation of the fabric includes pulling the fabric body onto a machine and joining the fabric ends to form an endless belt. Almost all dryer fabrics today have some type of seam.

An important aspect of loading a fabric body onto a paper machine is that there be uniform tension across the fabric. If uniform tension is not achieved and one section of the fabric pulls more than another, then the fabric can bubble or ridge across the fabric width.

Another aspect of loading a fabric body is preventing damage to the fabric body seam. In order to avoid or minimize the chance of damage to the seam during installation, uneven tension, weight and pressure must be avoided on the seam itself.

It has been common practice to attach zippers and Velcro-type leaders to fabrics by use of staples, sewing and/or adhesive materials. However, since these attachment methods can damage the fabric surface, it is preferable to use methods which do not damage the fabric.

A further aspect of loading a fabric, especially very long ones is properly aligning the fabric body in the machine so the fabric guides true in the machine direction (MD) and does not oscillate or track to one side of the machine. If the fabric guides or tracks poorly it can make contact with the paper machine support frame and cause fabric damage.

For fabrics and belts with seams that can be joined together on the paper machine, various types of leaders have been tried to assist installation. In order to avoid or minimize the potential for damaging the fabric body and the machine during installation and operation, the leader should be designed so there is uniform tension across the fabric body. There have been several attempts to design such leaders.

U.S. Pat. Nos. 5,306,393 and 5,429,719 both to Rhyne describe a device and method for installing a fabric body onto a paper machine. The method includes providing a self-aligning fabric loading harness having a leading edge and a plurality of spaced empty grommets disposed adjacent to the leading edge, to which multiple ropes are attached, securing a pull rope through a loading harness and a line receiving device, pulling the pull rope, and automatically readjusting the pull rope through the loading harness to attempt to achieve uniform tension across the fabric.

Some leaders are square or rectangular, with the long dimension in either the machine direction (MD) or cross-machine direction (CD). Multiple ropes or straps are attached to the leader at evenly spaced locations across the width of the leader. The leader with the attached papermaker's fabric or belt is pulled through the fabric run. The ends of the papermaker's fabric or belt are brought together and joined by a seam to make the fabric endless. The leader is removed and the fabric is ready for use. However, the multiple ropes or straps can get hung up on stationary equipment in the fabric run, causing a difficult and time consuming installation, if not tearing and damaging the fabric.

There are also leaders currently used in the industry which are shaped like an isosceles triangle, having the apex removed to form a trapezoid. The leaders are typically fabricated from a woven material, but the material can also be nonwoven. The base of a leader has a zipper, which is used to attach the leader to an end of the fabric being installed on the paper machine. Such a design is preferred because only one rope is attached near the apex to pull the fabric onto the machine. When the triangle is cut from woven material, one of the yarn systems in the weave goes straight from the base to the apex and the other is at a 90 degree angle thereto.

FIG. 1 shows a top view of a prior art leader 10. Leader 10 is shaped like an isosceles triangle and is fabricated from a woven material. The base 12 of leader 10 has one half of a zipper along its edge 12, which is used to attach leader 10 to an end of the fabric being installed on the paper machine to which the other half of the zipper is attached to the fabric or belt. Papermill personnel can attach a rope near the apex which is provided with a hole 14 and pull the fabric onto the machine. When the triangle is cut from woven material, one of the yarn systems in the weave goes straight from the base to the apex and the other is at a 90 degree angle thereto. When the rope is pulled as shown in FIG. 1*a*, the force is unevenly distributed across the leader as well as the attached fabric 16 which causes the fabric body to bunch on the sides 18.

Full width steel bars may be inserted at the base of the leader for better weight/tension distribution. However, the bars are heavy, thick and sometimes difficult to pass through the nip formed by two press rolls, or a shoe and opposing roll.

With a leader of this type, even with a 4 foot wide (in the cross machine direction or CD) steel reinforcing bar at the apex of the triangle/trapezoid, when the rope is pulled the force is unevenly distributed about the leader and across the attached fabric body. When the apex above is pulled, most of the force is distributed over the center four feet of the leader. This causes the center of the fabric to bunch up, making it more difficult to seam, and often causes the edges of the fabric or belt 16 and leader 10 to droop 18 and 20 while being pulled onto the paper machine.

The drawback of this type of leader is that the load is always concentrated down its center. This causes both the center of the leader and the fabric attached to it, to lead the edges and form waves in the center while pulling through the machine, making it more difficult to seam as well as guide the fabric through the run during installation. This often causes the edges of the fabric to droop while it is being pulled through the fabric run. Any fabric edge droop or bunching/waviness (i.e. any departure from a relatively flat fabric profile) can cause the fabric to become hung up on stationary equipment, or to not easily pass through the gap formed between two press rolls. Attempts to correct both the fabric and leader edges from drooping by inserting ropes down the edges, usually results in the edges curling up and folding over, which is also not desirable.

While the aforementioned types of methods and devices for installing an on machine seamable fabric or belt have particular advantages, they also have attendant disadvantages as discussed above.

SUMMARY OF THE INVENTION

The present invention is a device for assisting in the loading of papermaking fabrics. The device provides a solution to the problem of producing a uniform load across the fabric and aligning the fabric without damaging the fabric seam area.

It is therefore a principal object of the invention to overcome the shortcomings of the devices heretofore mentioned.

It is a further object of the invention to provide a device and method for installing a fabric in a paper machine which evenly distributes the load on the fabric making for easier installation and seaming.

Accordingly, the present invention is a multi-tier fabric loading harness for installing a fabric onto a papermaking machine. The loading harness has a first portion with a supporting rigid member that attaches to an end of the fabric in the cross-machine direction and a plurality of apertures spaced across its width. The first tier is formed by a rope sequentially laced through the apertures to form self-aligning loops. A second rope is sequentially laced through the loops of the first tier to form self-aligning loops for the second tier. A pulling ring gathers the loops of the second tier and is used to pull the fabric onto the papermaking machine.

Other aspects of the present invention include that the pulling ring may be delta shaped. The first portion may be a woven fabric. Preferably, the width of the first portion is commensurate with the width of the fabric in the cross-machine direction. The apertures are preferably grommets and the supporting rigid member is preferably a metal bar inserted across the first portion. The first portion may be attached to the fabric by a zipper means, pin seam, ravel, or other sewing method.

Another embodiment of the present invention is a multi-tier fabric loading harness similar to the preferred embodiment, but further comprising a spanning tier comprised of a plurality of rope spans slidably linking the self-aligning loops of the first tier to the self-aligning loops of the second tier.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

Figure 1:
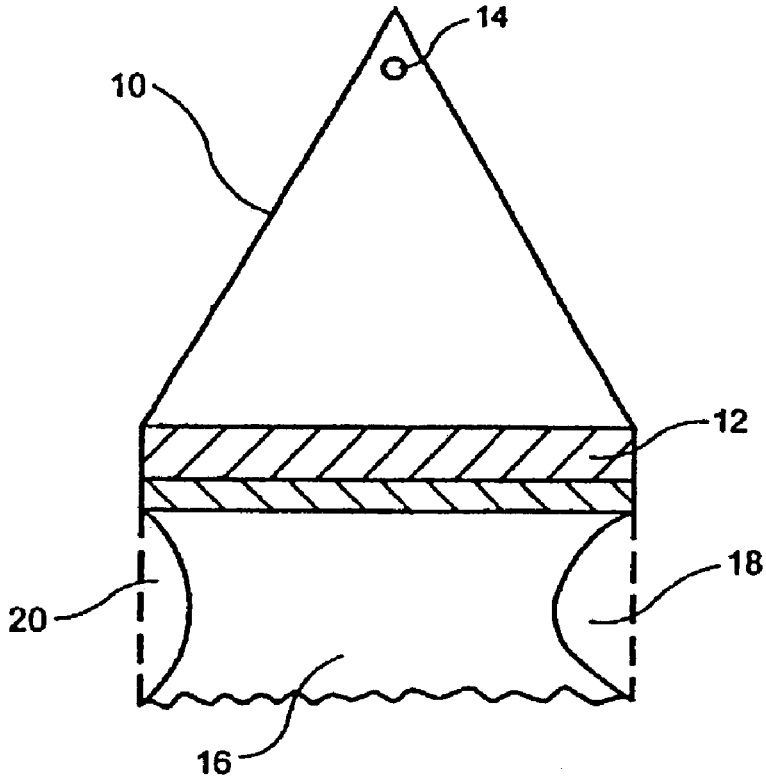
F I G. 1 PRIOR ART
FIG. 1 is a top view of a prior art leader.
Figure 1A:
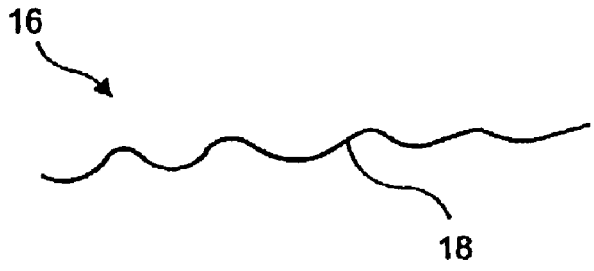
F I G. 1a PRIOR ART
FIG. 1*a* is a side view of a fabric attached to the leader of FIG. 1 after it has been pulled.
Figure 2:
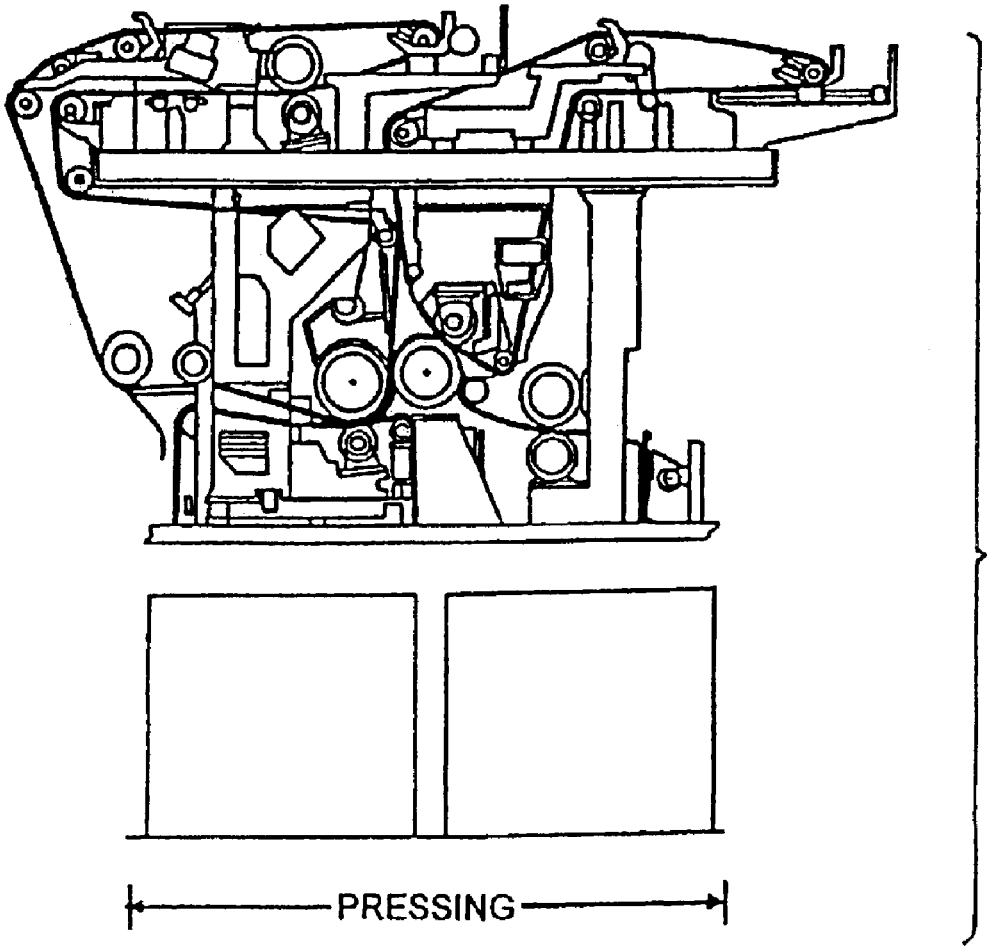
FIG. 2 is a side view illustrating a press section used in papermaking.
Figure 3:
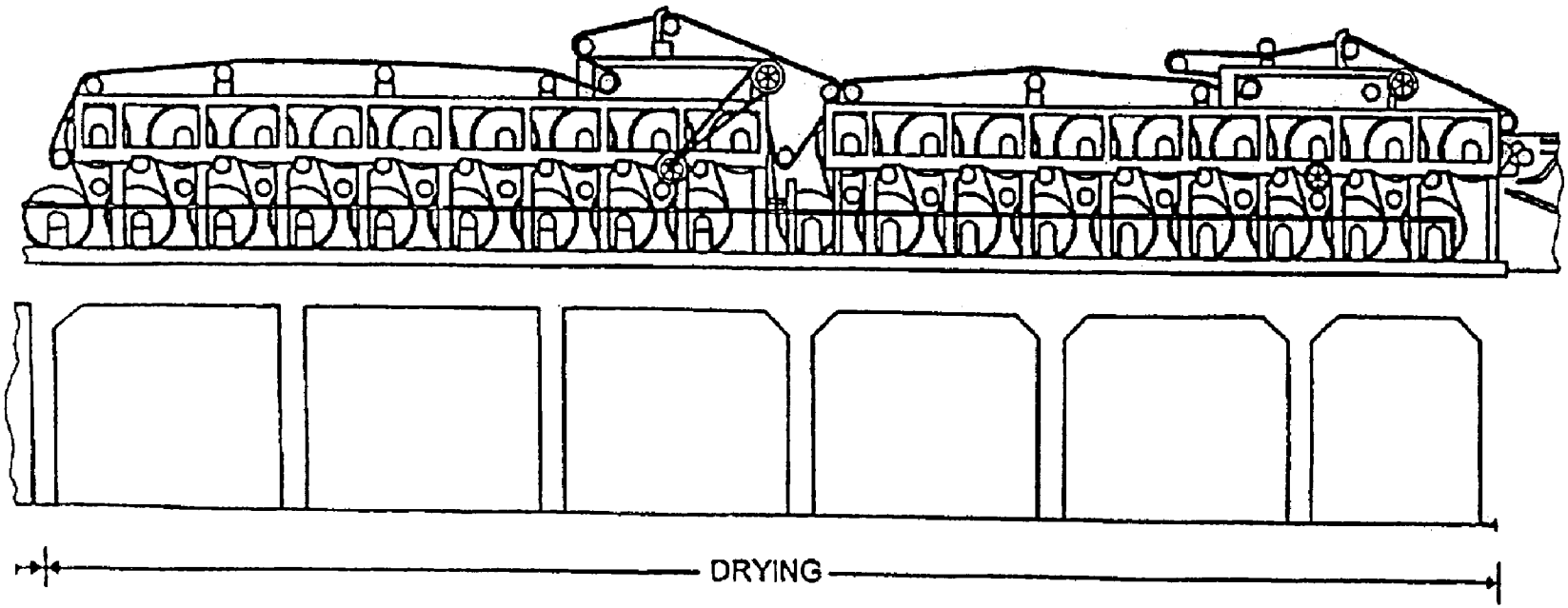
FIG. 3 is a side view illustrating a dryer section used in papermaking.

Initially, FIG. 2 shows a side view of the press section of a papermaking machine. FIG. 3 shows a side view of the drying section of a typical papermaking machine. The path of the fabric used in these sections is illustrated therein. The present invention is used to load a fabric onto such papermaking machines.

The multi-tier fabric loading harness according to the present invention is a rope harness attached to a leader to assist in loading fabrics onto paper machines. The harness is self-leveling and is constructed of at least two tiers with each tier being made from a continuous length of rope. The leader is supported widthwise by a rigid member. For example, a metal bar may be inserted through the entire width of the leader. The first tier (or level) of rope is formed by fastening the rope to an aperture at one edge of the leader and loosely looping the rope through a series of apertures across the width of the leader and fastening the end of the rope to an aperture at the other edge of the leader. The second tier of rope is formed by lacing the rope between the loops of the first tier and a pull ring. The ring used is preferably delta-shaped to reduce friction and drag that may occur with circular rings when rope loops bunch on one side of the ring when brought under tension. Other means of connecting the first and second tiers of rope such as a bar, rings at each loop intersection, or other connecting devices may be used.

Figure 4:
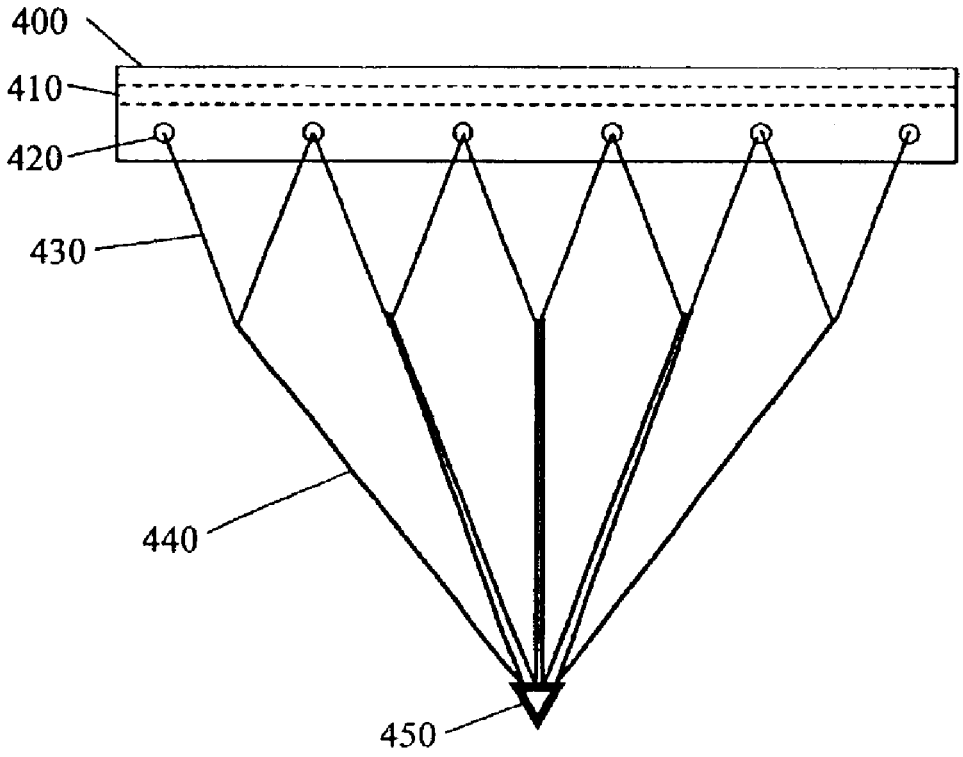
FIG. 4 is a top view of a preferred embodiment of the multi-tier rope harness according to the present invention.

The preferred embodiment of the present invention will now be described by reference to FIG. 4. The multi-tier fabric loading harness comprises a leader portion 400, a first rope harness tier 430, a second rope harness tier 440, and a pull ring 450. The leader is preferably made from a woven fabric material and is attached in the cross-machine direction to an end of the fabric to be loaded onto a papermaking machine. The leader may have a rigid supporting member 410 across its width. The member should have sufficient CD rigidity to evenly distribute a pulling load across the width of the leader, yet be thin and light enough to easily pass through the papermaking machine. Across the width of the leader are a series of evenly spaced apertures 420, or grommets. The grommets are used to connect the leader to the first rope tier of the harness. The first tier 430 is formed by attaching one end of the rope to an end grommet in the leader. The rope is then loosely laced through successive grommets thereby forming a series of loops. The end of the rope is then attached to the end grommet on the other edge of the leader. The second tier 440 is similarly formed by attaching one end of the rope to the first loop of the first tier. The rope is then loosely laced through successive first tier loops thereby forming a second series of loops. The end of the rope is then attached to the last loop in the first tier. The second tier loops are gathered and threaded through a pull ring 450. Note if the pull ring is a sealed ring then the second tier rope must be threaded through the ring when the loops are formed. When the pull ring is pulled in a direction away from the leader, the intertwined first and second tier ropes tension. Because the intertwined loops are not fixedly attached (i.e. they simply cross each other), the ropes can slide thereby allowing the harness to self-align. The pulling force is distributed across the leader by the self-aligning harness loops. Another rope may be attached to the pull ring in order to pull the harness.

The leader is attached to the fabric by an attachment means at its base 400. In a preferred embodiment, the leader is attached to the fabric by a zipper, one half of which is attached to the base 400 of the leader. The other half of the zipper is attached at or near the end of the fabric. Other means suitable for this purpose may also be employed.

Alternatively, the leader may be attached by a ravel area as disclosed in U.S. Pat. Ser. No. 10/177,821 filed Jun. 21, 2002; the contents of which are hereby incorporated by reference. Such a ravel area would run substantially parallel to the width of the leader. The ravel area is approximately 1" wide and is formed from a plurality of machine direction yarns. The ravel yarns connect two solid fabric portions of the leader. The ravel area would be placed over the seaming loops or other seaming mechanism at the end of the fabric. A pintle may then be passed through the ravel and seaming loops thereby securing one side of the leader to the fabric. Once the fabric is installed, the pintle is removed, detaching the leader.

Similarly, a ravel may be used to form the apertures at such intervals as may be desired for securing the harness rope to the leader. This allows for a secure attachment of pulling ropes or cables without the use of grommets and allows them to be so positioned to allow a uniform tension across the fabric during the pulling operation, since they can, if necessary, be repositioned during use.

Note that, while it is preferable to have a ravel area extend the entire, or substantially the entire, width of the leader, it need not. It might only exist in the areas to which the ropes or cables are to be attached. This, of course, would, to a certain extent, limit the repositioning of the ropes or cables during use to adjust for tension variations in various applications. In the case where a ravel area does extend the width of the leader, it may be desirable to mark thereon the preferred location of the ropes or cables for the particular applications.

It should be noted that the number of machine direction yarns in any ravel areas should be sufficient to provide the necessary strength for pulling the fabric, but should not be so great as to preclude the insertion of the harness rope into (and through) such areas.

When the fabric is to be installed on a paper machine, the leader 400 is attached to the fabric and a rope is attached to the pull ring 450 to draw the fabric through and around the components of the machine. Because of the harness design and the rigid supporting member, the load applied to the leader is evenly distributed across the fabric. The edges of the fabric do not droop and the load distribution is very uniform. Furthermore, the design of the leader allows for its repeated use with relatively heavy loads.

Figure 5:
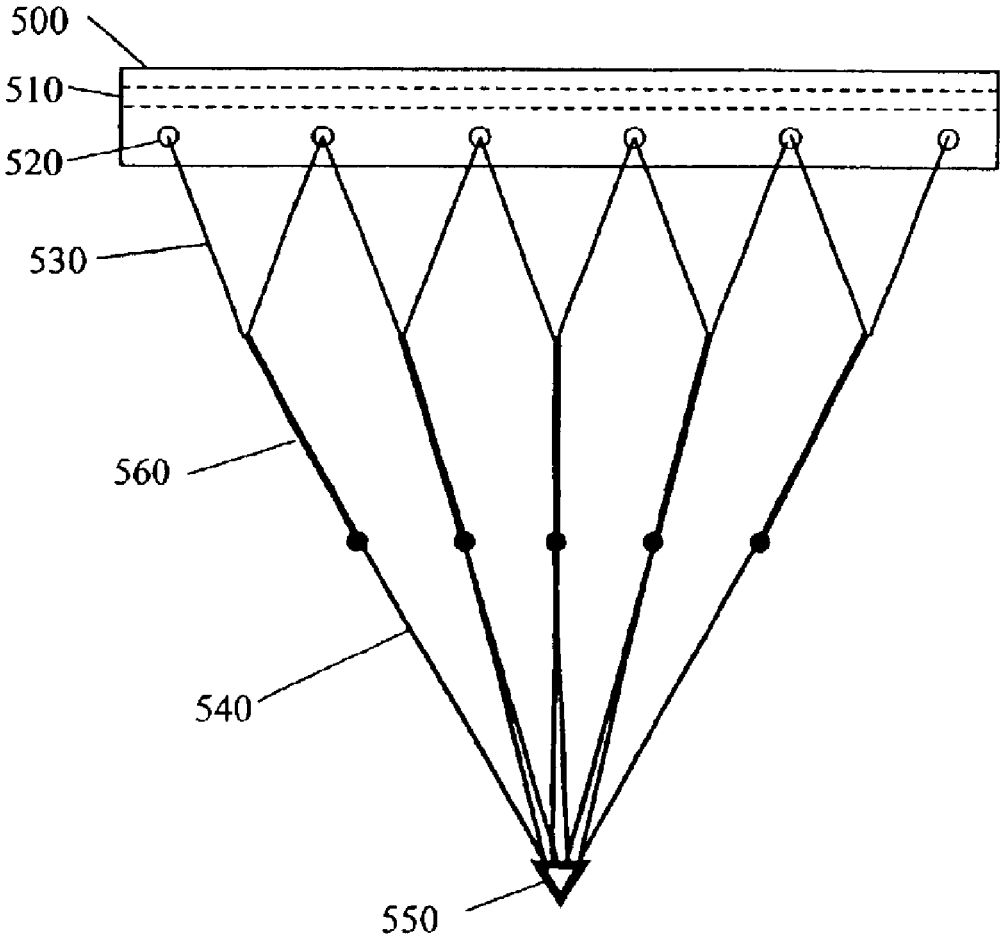
FIG. 5 is a top view of another embodiment of the multi-tier rope harness according to the present invention.

Another embodiment of the multi-tier rope harness according to the present invention is shown in FIG. 5. The multi-tier fabric loading harness according to this embodiment comprises a leader portion 500, a first rope harness tier 530, a spanning tier 560, a second rope harness tier 540, and a pull ring 550. The leader preferably has a rigid supporting member 510 across its width. Across the width of the leader are a series of evenly spaced apertures 520, or grommets. The first and second tiers are formed in a manner similar to that described in reference to FIG. 4. However, as shown in FIG. 5, a spanning tier comprised of a plurality of rope spans slidably link the self-aligning loops of the first tier to the self-aligning loops of the second tier. When the pulling rope is pulled in a direction away from the leader, the first, second, and spanning tier ropes tension. Because the spans are not fixedly attached, the ropes can slide thereby allowing the harness to self-align.

Further, in the present invention, the lengths of rope may be made from cable or a knitted/braided webbing material. Hence, other (webbing) materials may be substituted for the rope material.

In addition, while the leader may be made of a woven fabric material, non-woven materials, including reinforced and non-reinforced spunbonds might also be used. Knitted material can also be used. Triaxial woven material can also be used.

The design of the present invention distributes the load in an even manner allowing easier loading and seaming since the fabric is flat. The leader also pulls the fabric onto the machine uniformly due to the load distribution which keeps the fabric flat and prevents contact with stationary elements such as suction boxes or showers.

Modifications to the above would be obvious to those of ordinary skill in the art, but would not bring the invention so modified beyond the scope of the present invention. Thus, the present invention's objects and advantages are realized and although preferred embodiments have been disclosed and described in detail herein, their scope should not be limited thereby; rather their scope should be determined by that of the appended claims.

What is claimed is:

1. A multi-tier fabric loading harness for installing a fabric onto a papermaking machine, comprising:

a first portion having a first attaching edge for attaching to an end of the fabric in the cross-machine direction, a plurality of apertures spaced across a width of the first portion in the cross-machine direction, and a supporting rigid member across the entire width of the first portion;

a first rope sequentially laced through the plurality of apertures to form self-aligning loops for a first tier of the harness; a first end of the first rope being attached to a first edge aperture in the first portion; a second end of the first rope being attached to a second edge of the first portion to a last edge aperture;

a second rope sequentially laced through the self-aligning loops of the first tier to form self-aligning loops for a second tier of the harness; a first end of the second rope being attached to a first loop of the first tier and a second end of the second rope being attached to a last loop of the first tier; and a pull ring gathering the self-aligning loops of the second tier for use in pulling the fabric onto the papermaking machine.

2. The fabric loading harness according to claim 1, wherein the pull ring is delta-shaped.

3. The fabric loading harness according to claim 1, wherein the first portion is a woven fabric.

4. The fabric loading harness according to claim 1, wherein the width of the first portion is commensurate with the width of the fabric in the cross-machine direction.

5. The fabric loading harness according to claim 1, wherein the apertures are grommets.

6. The fabric loading harness according to claim 1, wherein the apertures are formed by a ravel area.

7. The fabric loading harness according to claim 1, wherein the supporting rigid member is a metal bar inserted across the width of the first portion.

8. The fabric loading harness according to claim 1, wherein the first portion is attached to the fabric by a zipper means or sewn/pinned to fabric loops.

9. The fabric loading harness according to claim 1, wherein the first portion is attached to the fabric by a ravel area.

10. The fabric loading harness according to claim 1, further comprising a spanning tier comprised of a plurality of rope spans slidably linking the self-aligning loops of the first tier to the self-aligning loops of the second tier.

11. The fabric loading harness according to claim 1, wherein the first and second ropes may be produced from a webbing material instead of a rope material.

* * * * *